US010702086B1

(12) United States Patent
Sayed

(10) Patent No.: US 10,702,086 B1
(45) Date of Patent: Jul. 7, 2020

(54) CURTAIN ROD HOLDER

(71) Applicant: KING SAUD UNIVERSITY, Riyadh (SA)

(72) Inventor: Hany Hassan Aly Sayed, Riyadh (SA)

(73) Assignee: King Saud University, Riyadh (SA)

( * ) Notice: Subject to any disclaimer, the term of this patent is extended or adjusted under 35 U.S.C. 154(b) by 0 days.

(21) Appl. No.: 16/745,895

(22) Filed: Jan. 17, 2020

(51) Int. Cl.
*A47H 1/142* (2006.01)
*A47H 1/14* (2006.01)

(52) U.S. Cl.
CPC ..... *A47H 1/142* (2013.01); *A47H 1/14* (2013.01)

(58) Field of Classification Search
USPC ..... 248/231.91, 261, 264, 268, 519, 523, 248/524, 511, 534, 535, 540, 541, 254, 248/257, 262, 265, 267, 269; 211/180, 211/105.1–105.6, 123
See application file for complete search history.

(56) References Cited

U.S. PATENT DOCUMENTS 983,692 A 2/1911 Deucker
1,049,355 A 1/1913 Haller
1,337,594 A 4/1920 Crosbie
1,349,933 A * 8/1920 Zeitz ..... A47H 1/13 248/255
1,351,697 A * 8/1920 Sheppard ..... A47H 1/13 248/253
1,468,167 A 9/1923 Pecora et al.
4,265,423 A 5/1981 Vecchiarelli
4,580,753 A 4/1986 Hennequin
4,700,918 A 10/1987 Andrasko, Jr.
5,492,295 A * 2/1996 Remmers ..... A47B 96/06 211/105.1
D464,252 S 10/2002 Jones
7,346,940 B1 3/2008 Liao
D722,488 S 2/2015 Lockwood et al.

FOREIGN PATENT DOCUMENTS

GB 2100586 A * 1/1983 ..... A47H 1/142

* cited by examiner

*Primary Examiner* — Alfred J Wujciak
(74) *Attorney, Agent, or Firm* — Richard C. Litman; Nath, Goldberg & Meyer

(57) ABSTRACT

A curtain rod holder includes a base having opposed first and second surfaces, with the second surface being adapted for mounting against a support surface. A first semi-cylindrical shell has axially-opposed first and second ends, with the first end thereof being fixedly mounted to the first surface of the base. The first semi-cylindrical shell has first and second diametrically opposed axially-extending edges. A second semi-cylindrical shell has axially-opposed first and second ends which are respectively aligned with the first and second ends of the first semi-cylindrical shell. The second semi-cylindrical shell has first and second diametrically opposed axially-extending edges, with the first axially-extending edge of the first semi-cylindrical shell being pivotally secured to the first axially-extending edge of the second semi-cylindrical shell by hinges or the like. The second axially-extending edge of the first semi-cylindrical shell is releasably lockable with the second axially-extending edge of the second semi-cylindrical shell.

12 Claims, 2 Drawing Sheets

CURTAIN ROD HOLDER

BACKGROUND

1. Field

The disclosure of the present patent application relates to supports and retainers, and particularly to a curtain rod holder having a split-cylindrical bracket for receiving the curtain rod in a lockable clamshell fashion.

2. Description of the Related Art

A conventional curtain rod holder, such as that typically used to hold a shower curtain rod, typically includes a cylindrical shell fixed to a base. The base is secured to wall by bolts, screws, adhesives or the like, and the cylindrical shell receives one end of the curtain rod. That end is then fixed to the curtain rod holder using screws or the like, securing the end of the curtain rod inside the cylindrical shell.

Although initially installing the curtain rod in such a curtain rod holder is relatively easy, removing the curtain rod therefrom is often quite difficult, requiring the use of tools in a very small and confined space. Further, when installed and uninstalled multiple times, the screws and curtain rod holder are highly susceptible to damage and misalignment. Thus, a curtain rod holder solving the aforementioned problems is desired.

SUMMARY

A curtain rod holder is provided for supporting and retaining an end of a curtain rod, such as a shower curtain rod, a curtain rod for drapery or the like. The curtain rod holder includes a base having opposed first and second surfaces, with the second surface being adapted for mounting against a support surface, such as a wall. A first semi-cylindrical shell has axially-opposed first and second ends, with the first end thereof being fixedly mounted to the first surface of the base. The first semi-cylindrical shell further has first and second diametrically opposed axially-extending edges. Similarly, a second semi-cylindrical shell has axially-opposed first and second ends which are respectively aligned with the first and second ends of the first semi-cylindrical shell. The second semi-cylindrical shell also has first and second diametrically opposed axially-extending edges, with the first axially-extending edge of the first semi-cylindrical shell being pivotally secured to the first axially-extending edge of the second semi-cylindrical shell by hinges or the like.

The second axially-extending edge of the first semi-cylindrical shell is releasably lockable with the second axially-extending edge of the second semi-cylindrical shell. In use, when the first and second semi-cylindrical shells are closed and locked with respect to one another, the first and second semi-cylindrical shells define a cylindrical retainer and support for an end of a curtain rod.

These and other features of the present subject matter will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
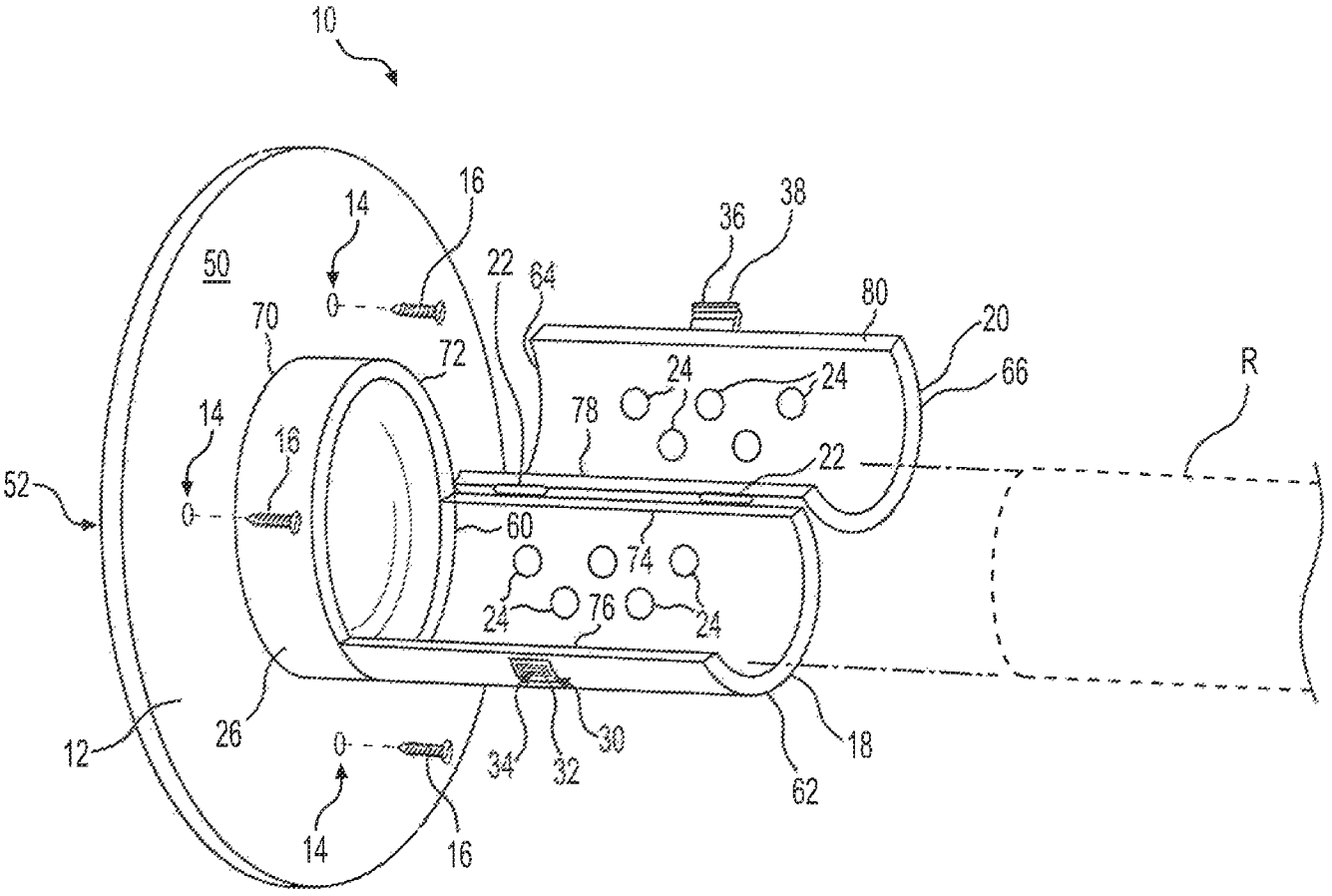
FIG. 1 is an environmental, perspective view of a curtain rod holder in an open and unlocked configuration.
Figure 2:
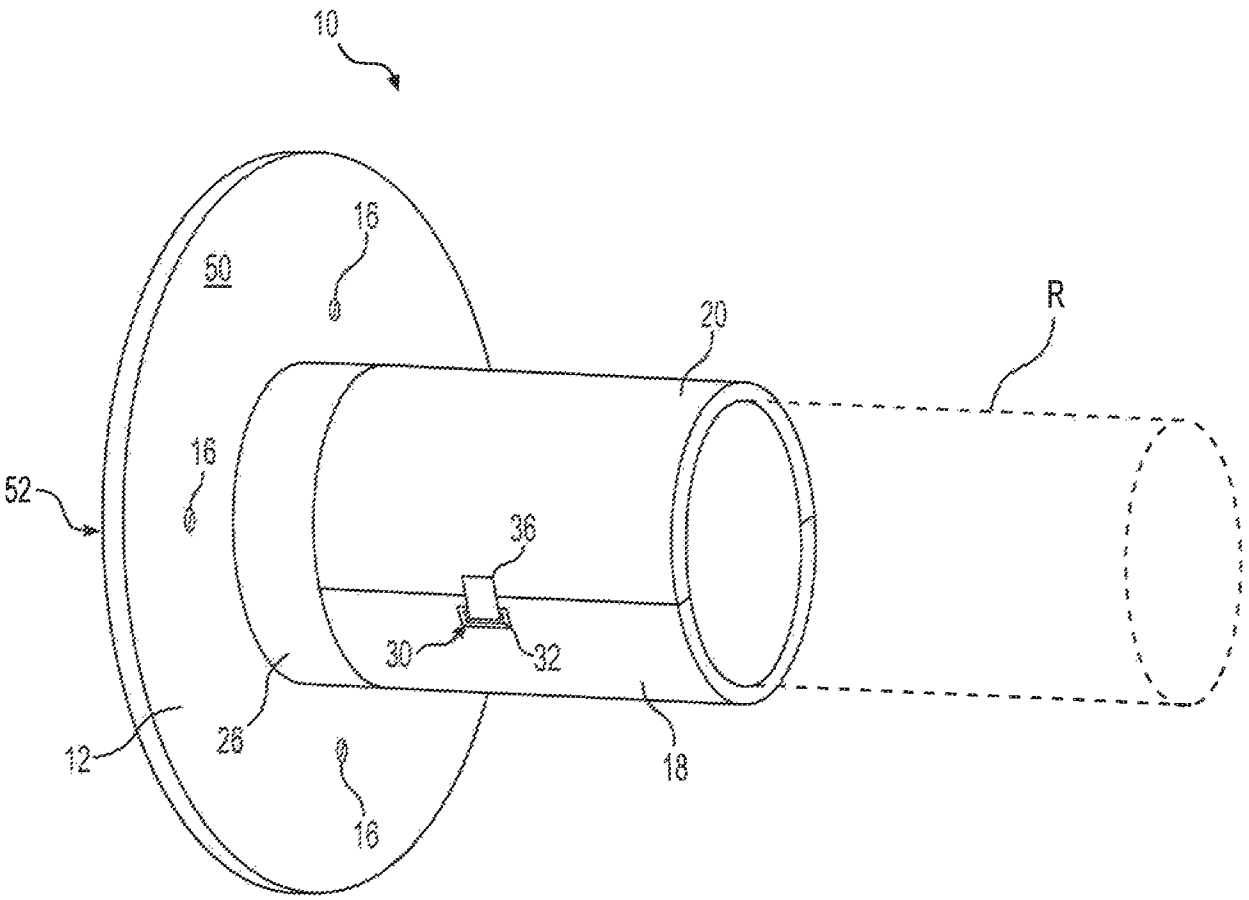
FIG. 2 is an environmental, perspective view of the curtain rod holder in a closed and locked configuration.

A curtain rod holder 10 is provided for supporting and retaining an end of a curtain rod R, such as a shower curtain rod, a curtain rod for drapery or the like. It should be understood that curtain rod R is shown in FIGS. 1 and 2 for exemplary and illustrative purposes only. The curtain rod holder 10 includes a base 12 having opposed first and second surfaces 50, 52, respectively, with the second surface 52 being adapted for mounting against a support surface, such as a wall. It should be understood that, though shown as having a circular contour, base 12 may have any desired contouring and relative dimensions. As shown in FIG. 1, a plurality of apertures 14 may be formed through the base 12 for receiving a plurality of screws 16 for fixation to the wall (or other support surface). However, it should be understood that base 12 may be secured to the wall or support surface by any suitable means of attachment, such as adhesives, bolts or the like.

A first semi-cylindrical shell 18 has axially-opposed first and second ends 60, 62, respectively, with the first end 60 being mounted to the first surface 50 of the base 12. In an embodiment, the first end 60 can be fixedly mounted to the first surface 50 of the base 12. The first semi-cylindrical shell 18 further has first and second diametrically opposed axially-extending edges 74, 76, respectively. As shown, a cylindrical shell 26, having axially opposed first and second ends 70, 72, respectively, may further be provided, such that the first end 70 of the cylindrical shell 26 is secured to the first surface 50 of the base 12, and the first end 60 of the first semi-cylindrical shell 18 is secured to the second end 72 of the cylindrical shell 26, thus spacing the first semi-cylindrical shell 18 away from the first surface 50 of the base 12.

Similarly, a second semi-cylindrical shell 20 has axially-opposed first and second ends 64, 66, respectively, which are respectively aligned with the first and second ends 60, 62 of the first semi-cylindrical shell 18. The second semi-cylindrical shell 20 also has first and second diametrically opposed axially-extending edges 78, 80, respectively, with the first axially-extending edge 74 of the first semi-cylindrical shell 18 being pivotally secured to the first axially-extending edge 78 of the second semi-cylindrical shell 20 by hinges 22 or the like. It should be understood that hinges 22 are shown for exemplary purposes only, and that any suitable type of hinges or pivotal connections may be utilized, including but not limited to, butt hinges, dovetail hinges, doweled butt hinges, and pin-and-hole hinges. Further, it should be understood that hinges 22 may be secured to first and second semi-cylindrical shells 18, 20 using any suitable method, such as by welding, using rivets or the like.

As shown, the cylindrical shell 26, the first semi-cylindrical shell 18 and the second semi-cylindrical shell 20 have equal radii and are positioned coaxially with respect to one another. It should be understood that the single radius, the thicknesses and the axial lengths of the cylindrical shell 26, the first semi-cylindrical shell 18 and the second semi-cylindrical shell 20 are shown in FIGS. 1 and 2 for exemplary purposes only, and may be varied dependent upon aesthetic preferences, as well as the size and style of curtain rod R which is to be received by curtain rod holder 10. As a non-limiting example, for a conventional curtain rod having a length of between approximately 2.5 m and approximately 3 m, the combined axial length of cylindrical shell 26 and the first and second semi-cylindrical shells 18, 20 may be at least 3 cm. In this non-limiting example, cylindrical shell 26 may have an axial length of approximately 0.5 cm. Further, it should be understood that the base 12, the cylindrical shell 26, the first semi-cylindrical shell 18 and the second semi-cylindrical shell 20 may be formed from any suitable type of material, such as plastic, sheet metal or the like. Hinges 22 may be formed from the same material as the other components of the curtain rod holder 10.

The second axially-extending edge 76 of the first semi-cylindrical shell 18 is releasably lockable with the second axially-extending edge 80 of the second semi-cylindrical shell 20. In use, when the first and second semi-cylindrical shells 18, 20 are closed and locked with respect to one another, the first and second semi-cylindrical shells 18, 20 define a cylindrical retainer and support for an end portion of curtain rod R, as illustrated in FIG. 2. The tip or edge of the end portion of the curtain rod R can be held within cylindrical shell 26, providing additional support and stability. Further, as shown in FIG. 1, padding 24 may be applied to the inner surfaces of the first semi-cylindrical shell 18 and the second semi-cylindrical shell 20 in order to cushion and stabilize the curtain rod R. It should be understood that any suitable type of padding material, such as foam rubber or the like, may be used. Further, it should be understood that padding 24 may be secured to the interior of the first semi-cylindrical shell 18 and the second semi-cylindrical shell 20 using any suitable type of securement, such as glue, epoxy or the like. It should be further understood that the simplified dots of padding 24 shown in FIG. 1 are shown for purposes of illustration only.

It should be understood that any suitable type of locking mechanism, clasp or the like may be used to releasably lock the first and second semi-cylindrical shells 18, 20 with respect to one another. In the non-limiting example of FIGS. 1 and 2, a locking tab 36 is secured to the second semi-cylindrical shell 20 adjacent the second axially-extending edge 80. Although shown in FIG. 2 as a separate piece, it should be understood the locking tab 36 may be integrally formed with the second semi-cylindrical shell 20. As shown in FIG. 1, locking tab 36 includes an engaging member 38, such that the engaging member is releasably received within a slot 34 located adjacent the second axially-extending edge 76 of the first semi-cylindrical shell 18. Corresponding to the above non-limiting exemplary dimensions, locking tab 36 may extend approximately 1.25 cm or less.

In the non-limiting example of FIGS. 1 and 2, a recess 30 is formed in the first semi-cylindrical shell 18 adjacent the second axially-extending edge 76. A locking member 32, having an opening formed therethrough, is received within recess 30, and the opening formed through locking member 32 defines slot 34. The recessed space around locking member 32 provides space for the user to insert a finger or tool to aid with engaging and disengaging the locking tab 36. Although the size and shape of slot 34 will depend upon the particular size, shape and type of engaging member 38 being used, as a non-limiting example, the inner surfaces of locking member 32 may be beveled, having an angle of 30° to 40°. Locking member 32 may be formed integrally with first semi-cylindrical shell 18, or may be fixed thereto using any suitable type of connection, such as a dovetail connection or the like. Further, it should be understood that, in the alternative, locking tab 36 may be mounted on first semi-cylindrical shell 18, and slot 34 may be defined in second semi-cylindrical shell 20.

It is to be understood that the curtain rod holder is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A curtain rod holder for hanging a curtain, comprising:

a base having opposed first and second surfaces, the second surface being adapted for mounting against a support surface;

a first semi-cylindrical shell having axially-opposed first and second ends, the first end thereof being connected to the first surface of the base, the first semi-cylindrical shell having first and second diametrically opposed axially-extending edges; and a second semi-cylindrical shell having axially-opposed first and second ends, the first and second ends thereof being respectively aligned with the first and second ends of the first semi-cylindrical shell, the second semi-cylindrical shell having first and second diametrically opposed axially-extending edges, the first axially-extending edge of the first semi-cylindrical shell being pivotally secured to the first axially-extending edge of the second semi-cylindrical shell, wherein the second axially-extending edge of the first semi-cylindrical shell is releasably lockable with the second axially-extending edge of the second semi-cylindrical shell, whereby when the first and second semi-cylindrical shells are closed and locked with respect to one another, the first and second semi-cylindrical shells define a cylindrical retainer and support for an end portion of a curtain rod for hanging the curtain;

and further comprising a cylindrical shell having axially opposed first and second ends, the first end thereof being secured to the first surface of the base, the first end of the first semi-cylindrical shell being secured to the second end of the cylindrical shell.

2. The curtain rod holder as recited in claim 1, wherein the cylindrical shell, the first semi-cylindrical shell and the second semi-cylindrical shell have equal radii and are positioned coaxially with respect to one another.

3. The curtain rod holder as recited in claim 1, further comprising a locking tab having an engaging member, the locking tab being secured to the second semi-cylindrical shell adjacent the second axially-extending edge thereof, the engaging member being releasably received within a slot located adjacent the second axially-extending edge of the first semi-cylindrical shell.

4. The curtain rod holder as recited in claim 3, further comprising a locking member having an opening formed therethrough, the locking member being received within a recess formed in the first semi-cylindrical shell adjacent the second axially-extending edge thereof, the opening defining the slot.

5. The curtain rod holder as recited in claim 1, wherein a plurality of apertures are formed through the base, the plurality of apertures being adapted for receiving a plurality of screws.

6. The curtain rod holder as recited in claim 1, wherein inner surfaces of the first semi-cylindrical shell and the second semi-cylindrical shell comprise a padding material.

7. A curtain rod holder for hanging a curtain, comprising:

a base having opposed first and second surfaces, the second surface being adapted for mounting against a support surface;

a cylindrical shell having axially opposed first and second ends, the first end thereof being secured to the first surface of the base;

a first semi-cylindrical shell having axially-opposed first and second ends, the first end of the first semi-cylindrical shell being secured to the second end of the cylindrical shell, the first semi-cylindrical shell having first and second diametrically opposed axially-extending edges; and a second semi-cylindrical shell having axially-opposed first and second ends, the first and second ends thereof being respectively aligned with the first and second ends of the first semi-cylindrical shell, the second semi-cylindrical shell having first and second diametrically opposed axially-extending edges, the first axially-extending edge of the first semi-cylindrical shell being pivotally secured to the first axially-extending edge of the second semi-cylindrical shell, wherein the second axially-extending edge of the first semi-cylindrical shell is releasably lockable with the second axially-extending edge of the second semi-cylindrical shell, whereby when the first and second semi-cylindrical shells are closed and locked with respect to one another, the first and second semi-cylindrical shells define a cylindrical retainer and support for an end of a curtain rod for hanging the curtain.

8. The curtain rod holder as recited in claim 7, wherein the cylindrical shell, the first semi-cylindrical shell and the second semi-cylindrical shell have equal radii and are positioned coaxially with respect to one another.

9. The curtain rod holder as recited in claim 7, further comprising a locking tab having an engaging member, the locking tab being secured to the second semi-cylindrical shell adjacent the second axially-extending edge thereof, the engaging member being releasably received within a slot located adjacent the second axially-extending edge of the first semi-cylindrical shell.

10. The curtain rod holder as recited in claim 9, further comprising a locking member having an opening formed therethrough, the locking member being received within a recess formed in the first semi-cylindrical shell adjacent the second axially-extending edge thereof, the opening defining the slot.

11. The curtain rod holder as recited in claim 7, wherein a plurality of apertures are formed through the base, the plurality of apertures being adapted for receiving a plurality of screws.

12. The curtain rod holder as recited in claim 7, wherein inner surfaces of the first semi-cylindrical shell and the second semi-cylindrical shell comprise a padding material.

* * * * *